United States Patent [19]

Brown et al.

[11] Patent Number: 4,763,468

[45] Date of Patent: Aug. 16, 1988

[54] PROCESS FOR MANUFACTURING A HIGH STRENGTH CORD FROM OPTIMALLY DRAWN YARN

[75] Inventors: Donald L. Brown, Hudson; James T. Weissert, Akron; Roop S. Bhakuni, Copley, all of Ohio; Gregory S. Rogowski, Arlington, Va.

[73] Assignee: The Goodyear Tire & Rubber Company, Akron, Ohio

[21] Appl. No.: 925,940

[22] Filed: Nov. 3, 1986

Related U.S. Application Data

[62] Division of Ser. No. 802,895, Nov. 29, 1985, Pat. No. 4,654,253.

[51] Int. Cl.[4] ..... D02J 1/22; D02G 3/28; D02G 3/48

[52] U.S. Cl. ..... 57/310; 28/240; 57/243; 57/309; 57/902; 264/210.7; 264/210.8; 264/290.5

[58] Field of Search ..... 57/309, 310, 313, 902, 57/243–247; 28/240, 245; 264/210.1, 210.7, 210.8, 290.5, 290.7, 288.4

[56] References Cited

U.S. PATENT DOCUMENTS

| | | | |
|---|---|---|---|
| 3,216,187 | 11/1965 | Chantry et al. | 57/902 X |
| 3,469,001 | 9/1969 | Keefe, Jr. | 57/902 X |
| 3,481,136 | 12/1969 | Timmons, Jr. et al. | 57/310 X |
| 3,564,835 | 2/1971 | Keefe, Jr. et al. | 57/310 X |
| 3,987,136 | 10/1976 | Schippers | 57/902 X |
| 4,112,667 | 9/1978 | Hatcher et al. | 57/310 |
| 4,215,530 | 8/1980 | Beau et al. | 57/310 |
| 4,623,011 | 11/1986 | Kanuma | 57/902 X |

*Primary Examiner*—John Petrakes

*Attorney, Agent, or Firm*—Alvin T. Rockhill

[57] ABSTRACT

The present invention reveals a process for manufacturing a high strength woven fabric that is particularly suitable for use as a tire reinforcement which comprises:

(a) drawing a polymeric yarn to a draw ratio that is 70% to 99% of the draw ratio that would fully draw the yarn to produce an optimally drawn yarn;

(b) twisting at least two of said optimally drawn polymeric yarns into a cord;

(c) weaving a plurality of said cords into a greige woven fabric; and (d) stretching and relaxing said greige woven fabric under conditions sufficient to reduce the denier of the cords in said fabric by 1% to 10%.

4 Claims, No Drawings

PROCESS FOR MANUFACTURING A HIGH STRENGTH CORD FROM OPTIMALLY DRAWN YARN

This is a divisional of application Ser. No. 802,895 filed on Nov. 29, 1985 (now issued as U.S. Pat. No. 4,654,253).

BACKGROUND OF THE INVENTION

High strength woven fabrics are often utilized as a reinforcement in a wide variety of products, such as belts, hoses, and tires. The process utilized in making such high strength woven fabrics has traditionally involved (a) spinning a polymeric material into a fully drawn yarn; (b) twisting at least two fully drawn polymeric yarns into a cord: and (c) weaving a plurality of said cords into a greige woven fabric. Such greige woven fabrics are commonly treated with various chemical agents before incorporation into products. For example, greige woven tire fabric is normally treated in a resorcinol-formaldehyde-latex (RFL) dip before incorporation into tires.

The yarns utilized in making cords for incorporation into high strength fabrics have traditionally been fully drawn in order to attain the required combination of mechanical properties. For instance, fully drawn yarns are utilized in order to provide high strength. The incorporation of yarns which are not fully drawn into high strength fabrics utilizing conventional techniques results in a substandard product. For this reason, virtually all conventional tire cords are manufactured utilizing fully drawn yarns.

There are many problems associated with making fully drawn yarns. For instance, filaments in fully drawn yarns commonly break in the process of being drawn. In a commercial process this problem of breakage causes downtime and waste and is highly undesirable. Fully drawn yarns can also be damaged due to overdrawing. For example, white streaking and broken filaments (fuzziness) frequently occur in the process of fully drawing yarns. These problems become more acute as spinning speeds are increased, and the trend today is toward higher and higher spinning speeds in order to increase throughputs and to improve dimensional stability. The majority of these problems are virtually eliminated when yarns are less than fully drawn (incompletely drawn). Unfortunately, in the past it has not been possible to utilize incompletely drawn yarns in manufacturing high strength fabrics of high quality.

SUMMARY OF THE INVENTION

The present invention reveals a technique for utilizing partially drawn yarns in manufacturing high strength woven fabrics which are as good or better than fabrics made utilizing fully drawn yarns. In fact, high strength fabrics which are made by utilizing partially drawn yarns in conjunction with the technique of the present invention generally have more uniformity and higher break strengths than do fabrics which are made with fully drawn yarns utilizing conventional techniques.

Since it is only necessary to partially draw the yarns that are utilized in the present invention, they can be made without encountering the problems associated with making fully drawn yarns. This means that white streaking, fibrillation, and other types of damage associated with overdrawing can be virtually eliminated in such partially drawn yarns. Another advantage associated with manufacturing partially drawn yarns is that they can be made at higher throughputs and with less breakage than can fully drawn yarns.

The partially drawn yarns that are utilized in the practice of the present invention are drawn to a draw ratio that is 70 to 99% of the draw ratio that would be required to fully draw the yarn. Even though such yarns are only partially drawn they are considered to be optimally drawn for purposes of the present invention. In the practice of the present invention such optimally drawn yarns are twisted into cords which are in turn woven into fabric. The fabric is then stretched or drawn in order to provide it with higher strength and other required properties. In effect, the process of drawing the yarns is completed after they are incorporated into the fabric. This technique is particularly suitable in manufacturing high strength woven fabrics that are utilized as tire reinforcements.

The present invention more specifically reveals a process for manufacturing a high strength woven fabric from a greige woven fabric which comprises stretching and relaxing said greige woven fabric under conditions sufficient to reduce the denier of the cords in said fabric from 1% to 10%; wherein said greige woven fabric is comprised of a plurality of cords wherein said cords are comprised of at least two optimally drawn polymeric yarns; wherein said optimally drawn polymeric yarns were drawn at less than the draw ratio that would fully draw the yarns.

The present invention also discloses a process for manufacturing a high strength woven fabric that is particularly suitable for use as a tire reinforcement which comprises:

(a) drawing a polymeric yarn to a draw ratio that is 70% to 99% of the draw ratio that would fully draw the yarn to produce an optimally drawn yarn:

(b) twisting at least two of said optimally drawn polymeric yarns into a cord:

(c) weaving a plurality of said cords into a greige woven fabric; and (d) stretching and relaxing said greige woven fabric under conditions sufficient to reduce the denier of the cords in said fabric from 1% to 10%.

The present invention also relates to a process for manufacturing a high strength cord which comprises:

(a) twisting at least two optimally drawn polymeric yarns into a greige cord, wherein said optimally drawn polymeric yarns were drawn at less than the draw ratio that would fully draw said yarns; and (b) stretching and relaxing said greige cords under conditions sufficient to reduce the denier of the cords by 1% to 10%.

DETAILED DESCRIPTION OF THE INVENTION

The yarns utilized in the high strength woven fabrics of the present invention are made using conventional equipment and standard techniques except for the fact that they are only partially drawn. For example, such yarns can be made by melt spinning, solution spinning, or gel spinning. Because these yarns are incompletely drawn, the draw ratio used in making them is less than the draw ratio that would be needed to draw them fully. In most cases, the draw ratio used will be from 70% to 99% of the draw ratio that would fully draw the yarn. It is normally preferred for a draw ratio of from 80% to 98% of the draw ratio that is required to fully draw the yarn to be utilized in making the optimally drawn yarns. It is most preferred in many cases to utilize a draw ratio of 90% to about 97% of the draw ratio that would fully draw the yarn. Numerous techniques which are well known to persons skilled in the art can be used to make such optimally drawn yarns. The yarns which are incorporated into the fabrics of the present invention can be made out of a variety of polymeric materials. For instance, such yarns can be comprised of nylons or polyesters.

The yarns utilized in accordance with this invention will most commonly be comprised of a polyester. Such polyesters are comprised of repeat units which are derived from at least one diacid component and at least one diol component. The diacid component utilized in the preparation of such polyesters can, of course, technically be a diester. For example, dimethyl terephthalate could be utilized as the diacid component in the preparation of a polyester in lieu of terephthalic acid. The term "diacid component" as used herein is therefore intended to include diesters. The term "diol component" as used herein is also deemed to include glycol ethers (diethers) and polyether glycols.

The diacid component utilized in the polyesters which are most commonly utilized in making the yarns of this invention are normally alkyl dicarboxylic acids which contain from 4 to 36 carbon atoms, diesters of alkyl dicarboxylic acids which contain from 6 to 38 carbon atoms, aryl dicarboxylic acids which contain from 8 to 20 carbon atoms, diesters of aryl dicarboxylic acids which contain from 10 to 22 carbon atoms, alkyl substituted aryl dicarboxylic acids which contain from 9 to 22 carbon atoms, or diesters of alkyl substituted aryl dicarboxylic acids which contain from 11 to 22 carbon atoms. The preferred alkyl dicarboxylic acids will contain from 4 to 12 carbon atoms. Some representative examples of such alkyl dicarboxylic acids include glutaric acid, adipic acid, pimelic acid, and the like. The preferred diesters of alkyl dicarboxylic acids will contain from 6 to 12 carbon atoms. A representative example of such a diester of an alkyl dicarboxylic acid is azelaic acid. The preferred aryl dicarboxylic acids contain from 8 to 16 carbon atoms. Some representative examples of aryl dicarboxylic acids are terephthalic acid, isophthalic acid, and orthophthalic acid. The preferred diesters of aryl dicarboxylic acids contain from 10 to 15 carbon atoms. Some representative examples of diesters of aryl dicarboxylic acids include diethyl terephthalate, diethyl isophthalate, diethyl orthophthalate, dimethyl naphthalate, diethyl naphthalate and the like. The preferred alkyl substituted aryl dicarboxylic acids contain from 9 to 16 carbon atoms and the preferred diesters of alkyl substituted aryl dicarboxylic acids contain from 11 to 15 carbon atoms.

The diol component utilized in the preparation of such polyesters is normally a glycol that contains from 2 to 12 carbon atoms or a glycol ether that contains from 4 to 12 carbon atoms. Preferred glycols normally contain from 2 to 8 carbon atoms with preferred glycol ethers containing from 4 to 8 carbon atoms. Some representative examples of glycols that can be utilized as the diol component include ethylene glycol, 1,3-propylene glycol, 1,2-propylene glycol, 2,2-diethyl-1,3-propane diol, 2,2-dimethyl-1,3-propane diol, 2-ethyl-2-butyl-1,3-propane diol, 2-ethyl-2-isobutyl-1,3-propane diol, 1,3-butane diol, 1,4-butane diol, 1,5-pentane diol, 1,6-hexane diol, 2,2,4-trimethyl-1,6-hexane diol, 1,3-cyclohexane dimethanol, 1,4-cyclohexane dimethanol, 2,2,4,4-tetramethyl-1,3-cyclobutane diol, and the like. Some representative examples of polyether glycols that can be used include polytetramethylene glycol (Polymeg TM) and polyethylene glycol (Carbowax TM). These polyether glycols have the general structural formula $HOA—O_nH$ wherein A is an alkylene group containing from 2 to 6 carbon atoms and wherein n is an integer from 2 to 400. Generally the polyethylene glycol will have a molecular weight of 400 to 4000.

Such polyesters can also be branched. Such branching is normally attained by utilizing a branching agent in the polyesterification reaction utilized in the synthesis of the polyester. Such branching agents normally contain three or more functional groups and preferably contain three or four functional groups. The reactive groups may be carboxyl or aliphatic hydroxyl. The branching agent can contain both types of groups. Examples of acidic branching agents include trimesic acid, trimellitic acid (or trimellitic anhydride), pyromellitic acid, butane tetracarboxylic acid, naphthalene tricarboxylic acids, cyclohexane-1,3,5-tricarboxylic acids, and the like. Some representative examples of hydroxyl branching agents (polyols) include glycerin, trimethylol propane, pentaerythritol, dipentaerythritol, 1,2,6-hexane triol, and 1,3,5-trimethylol benzene. Generally, from 0 to 3 percent of a polyol containing from 3 to 12 carbon atoms will be used as the branching agent (based upon the total diol component). Such polyesters can also be treated with carbodiimides or hydantoin diepoxide in order to improve their hydrolytic and thermal stability.

The cords used in the high strength woven fabrics of this invention are made by twisting together two or more optimally drawn yarns which are made from a polymeric material. Most commonly, cords are made by twisting together two or three yarns. Standard techniques which are well known to persons skilled in the art can be used in twisting the optimally drawn yarns into cords.

A plurality of cords which are made out of optimally drawn yarns can then be woven into a greige woven fabric by utilizing standard weaving techniques. In accordance with the practice of the present invention the greige woven fabric is stretched under conditions wherein further drawing is accomplished. This is generally done at an elevated temperature. For example, in the case of polyester yarns, a temperature between 200° C. and 280° C. will commonly be utilized with a temperature of 230° C. to 250° C. being preferred in the case of polyethylene terephthalate yarns. In many cases it will be convenient to provide this additional drawing while the greige fabric is being dipped. This is because the conditions commonly used in conventional dipping procedures can be easily modified so as to provide adequate tensions in order to accomplish the desired degree of additional drawing. In making high strength tire fabrics, the greige woven fabric can easily be stretched and subsequently relaxed in the RFL (resorcinol-formaldehyde-latex) dip. In other words, the woven fabric can be subjected to higher tensions in the RFL dip in order to provide it with further drawing which is necessary in order for the high strength fabric being made to have the requisite combination of mechanical properties. Such greige woven tire fabrics can be stretched and relaxed under tension before being dipped if so desired.

The tension required and process conditions utilized in stretching and relaxing the greige woven fabric will normally be sufficient to reduce the denier of the cords in the greige woven fabric by 1% to 10% (based upon their denier prior to being stretched and relaxed in the greige woven fabric). It is generally preferred to reduce the denier of the cords by 2% to 5% during the process of stretching and relaxing the woven fabric. During the process of stretching and relaxing greige woven fabrics which are made utilizing standard modulus optimally drawn yarns, the load required to elongate the fabric by 5% (LASE) is normally decreased by 20% to 60%. It is preferred for the load required to elongate such woven fabrics 5% to be reduced by 40% to 50% during the process of stretching and relaxing the woven fabric. The tension and process conditions required to reduce denier and LASE by these specified amounts will vary with the type of polymer from which the yarns utilized are made and the denier of the optimally drawn yarns utilized in making the fabric. However, persons skilled in the art will be able to ascertain the tension, temperature and other process conditions required to achieve these objectives. Typically, the load required to elongate a greige woven fabric made utilizing standard modulus optimally drawn yarns 5% before stretching and relaxing is from about 13 pounds to about 17 pounds with the load required to elongate the woven fabric 5% after stretching and relaxing being reduced to about 8 pounds to about 10 pounds. The optimally drawn yarns in such woven tire fabrics typically have a denier of 1,020 to 1,060 prior to being stretched and relaxed, and accordingly, have an average denier of from about 990 to 1,010 after being stretched and relaxed. Optimally drawn yarns having higher deniers prior to being stretched and relaxed can also be utilized in making woven tire fabrics containing yarns having other typical deniers, such as 1300 or 1500, after stretching and relaxing the woven fabrics.

High modulus optimally drawn yarns can also be utilized in the process of the present invention. During the process of stretching and relaxing greige woven fabrics which are made utilizing high modulus optimally drawn yarns the load required to elongate the fabric 5% is increased. Generally, this increase in the load required to elongate the fabric 5% will be from about 10% to about 40%. It is normally preferred for this increase in LASE at 5% to be of about 15% to about 25%.

This invention is illustrated by the following examples which are merely for the purpose of illustration and are not to be regarded as limiting the scope of the invention or the manner in which it can be practiced. Unless specifically indicated otherwise, parts and percentages are given by weight.

EXAMPLE 1

A conventional two step process of spinning followed by draw twisting was utilized in making an optimally drawn yarn. In the spinning step high molecular weight polyethylene terephthalate having an initial intrinsic viscosity of 0.95 was melted and extruded at a temperature of about 295° C. A throughput of 58 lbs./hour (26 kg./hour) was maintained. The molten filaments being produced were passed through a heated collar and cooled in a quench chamber which was 6 feet (183 cm.) long which was cooled with air at ambient temperature which was supplied at a rate of 100 ft./min. (30 m./min.). Lubricating oil was applied to the filaments which were wound on a bobbin at a speed of 842 yds./min. (770 m./min.).

The as spun yarn on the bobbin was then taken to a draw twister and drawn utilizing a draw ratio of 5.31 at a temperature of about 215° C., resulting in an optimally drawn yarn having a drawn denier of 1,035. The draw ratio utilized was about 96.5% of the draw ratio that would have fully drawn the yarn. A tire cord was then made using standard procedures by twisting two of such optimally drawn yarns into a tire cord. The two ply tire cord was made so as to have 12 turns per inch in the ply and 12 turns per inch in the cable.

A tire fabric containing 1,710 cord ends was then woven utilizing the greige tire cords which were made out of the optimally drawn yarns. The process used in weaving the tire fabric was in all other respects a standard procedure. The greige tire fabric made was determined to have a denier of 2,300, a break strength of 34.4 lbs. (15.6 kgs.) a LASE at 5% of 14.9 lbs. (6.8 kgs.) and an elongation at break of 19.2%. The greige tire fabric was then dipped in a conventional RFL dip utilizing a tension in the stretch zone of 4,700 lbs. (2,132 kgs.). The tension utilized in the relax zone was 1,100 lbs. (499 kgs.). A temperature of about 460° F. (238° C.) was maintained in the RFL dip. The tire fabric made was determined to have a break strength of 33.2 lbs. (15 kgs.), a LASE at 5% of 9.0 lbs. (4.1 kgs.), an elongation at break of 19.0% and a shrinkage of 4.0 percent after 2 minutes at 350° F. (177° C.). The cords in the tire fabric were determined to have a denier of 2,365 after being dipped and stretched. This is equivalent to an undipped cord having a denier of 2,230 since there was a dip pickup of 6%. Thus, there was a 3% reduction in the denier of the cords themselves.

The tire fabric was then utilized in manufacturing P205/75R15 Custom Polysteel TM tires. The tires were successfully built with no problems encountered during component preparation or tire building and curing. The tires were then evaluated in DOT high speed, endurance, and underinflated wheel tests. They were determined to be equivalent to control tires which were made with tire fabrics made out of fully drawn yarns.

This example shows that optimally drawn yarns can be utilized in making commercially acceptable tire fabric. However, several distinct advantages were realized in making the optimally drawn yarns. For instance, white streaking during drawing and creel tangles during beaming were virtually eliminated in utilizing this technique for making optimally drawn yarns. Improved beamed yarn appearance was also achieved. Additionally, the breakage experienced during drawing was reduced by about 50 percent. Perhaps most importantly it was possible to increase the spinning speed by over 20 percent and to increase the throughput by over 16% above the maximum spinning speed and throughput that could be previously utilized in making fully drawn yarns. Thus, productivity was increased by over 16%.

EXAMPLE 2

The procedure specified in Example 1 can be modified so as to utilize a draw ratio of 5.39, a spinning speed of 692 yds./min. (633 m./min.) and a throughput of 50 lbs./hr. (22.2 kg./hr.) in producing optimally drawn yarns. The optimally drawn yarns made utilizing these conditions will have a denier of about 1.035. will be drawn to about 96.5% of the draw ratio that would fully draw them, and can be utilized in making woven tire fabrics in the manner described in Example 1. However, this modification will not normally be practiced since it does not result in the increased productivity that can be achieved by utilizing the procedure specified in Example 1. Nevertheless, using this procedure will virtually eliminate white streaking during drawing and creel tangles during beaming. Its use will also greatly reduce breakage experienced during drawing and improve the appearance of beamed yarn.

EXAMPLE 3

A continuous high speed spin-draw process was utilized in making a high modulus optimally drawn yarn. High molecular weight polyethylene terephthalate having an initial intrinsic viscosity of 1.04 was spun into 380 filaments utilizing an extruder temperature of about 290° C. A spinning speed of 2,500 m./min. and a throughput of about 80 lbs./hr. (36 kg./hr.) were maintained. A total draw ratio of 2.20 and a winding speed of 5,445 m./min. were utilized in order to produce high modulus optimally drawn yarns having a denier of 1,033.

The high modulus optimally drawn yarns produced were twisted into a three ply tire cord having 8.5 turns per inch in the ply and 8.5 turns per inch in the cable using standard techniques. The greige tire cords made were determined to have a denier of 3,357, a tensile strength of 46.4 lbs. (21 kgs.), a LASE at 5% of 12.0 lbs. (5.4 kgs.), and an elongation at break of 19.4%.

The greige tire cords made in this experiment were then stretched 6% and relaxed 4% during dipping at 465° F. (241° C.) in an RFL dip. After this dipping the cords had a break strength of 44.1 pounds (20.0 kg.), an LASE at 5% of 14.9 pounds (6.8 kg.), an elongation at break of 15.7%, and a shrinkage of 2% after 2 minutes at 350° F. (177° C.). Such cords can then be woven into high strength, dimensionally stable tire fabric which is particularly suitable for use in making monoply radial passenger tires.

While certain representative embodiments and details have been shown for the purpose of illustrating the present invention, it will be apparent to those skilled in this art that various changes and modifications can be made therein without departing from the scope of the invention.

What is claimed is:

1. A process for manufacturing a high strength cord which comprises:

(a) twisting at least two optimally drawn polymeric yarns into a greige cord, wherein said optimally drawn polymeric yarns were drawn at a draw ratio that is 90 to 97% of the draw ratio that would fully draw the yarn; and (b) stretching and relaxing said greige cords under conditions sufficient to reduce the denier of the cords by 1% to 10% to an average denier of from about 990 to about 1,010.

2. A process as specified in claim 1 wherein said polymeric yarns are comprised of a member selected from the group consisting of nylons and polyesters.

3. A process as specified in claim 1 wherein said polymeric yarns are comprised of polyethylene terephthalate.

4. A process as specified in claim 3 wherein said greige cords are stretched and relaxed under conditions sufficient to reduce the denier of the cords by 2% to 5%.

* * * * *